United States Patent [19]

Deussner et al.

[11] 3,942,942

[45] Mar. 9, 1976

[54] ROTARY TUBULAR FURNACE

[75] Inventors: Herbert Deussner, Bensberg-Refrath; Joachim Fleischer, Cologne, both of Germany

[73] Assignee: Klockner-Humboldt-Deutz AG, Germany

[22] Filed: July 25, 1974

[21] Appl. No.: 491,810

[30] Foreign Application Priority Data

July 28, 1973 Germany ..... 2338443

[52] U.S. Cl. ..... 432/80; 34/13; 432/85

[51] Int. Cl.[2] ..... F27D 15/00; F27D 15/02

[58] Field of Search ..... 34/13; 432/80, 85

[56] References Cited

UNITED STATES PATENTS 3,824,069 7/1974 Brachthauser et al. ..... 432/80

3,839,086 10/1974 Larson ..... 437/85

*Primary Examiner*—John J. Camby

*Attorney, Agent, or Firm*—Hill, Gross, Simpson, Van Santen, Steadman, Chiara & Simpson

[57] ABSTRACT

A rotary tubular furnace is provided at its outlet end with a satellite cooler comprising a plurality of cooling tubes uniformly spaced around the end portion of said tubular furnace and/or a tubular extension thereof, and each of said cooling tubes is provided with an influent member which during the rotation of the furnace intermittently dips into a cooling liquid bath to thereby supply cooling liquid to the respective cooling tube in regulatable quantities, said cooling liquid bath being connected with a supply of cooling liquid by a stationary supply conduit.

7 Claims, 4 Drawing Figures

ROTARY TUBULAR FURNACE

This invention relates to a rotary tubular furnace which is provided with a satellite cooler, i.e., a plurality of cooling tubes uniformly spaced around the circumference of the furnace at the discharge end thereof.

The temperature of the clinker leaving the cooling tubes of a satellite cooler can be lowered by spraying water by means of nozzles into said cooling tubes. The supplying of water is, however, in the case of a satellite cooler with a plurality of cooling tubes uniformly spaced around the periphery of the discharge end of a rotary tubular furnace not readily feasible since a supply conduit which is coaxial with the rotary furnace, cannot be provided for practical reasons.

The object of the invention is to provide a device which in a simple and particularly economic manner enables continuous feeding of sufficient quantities of cooling liquid into the cooling tubes of a satellite cooler. This problem is solved by providing at least one liquid bath which is in communication with a source of liquid, and by connecting to each cooling tube at least one liquid supply tube which in operation dips intermittently into the liquid bath. The special advantage of this inventive arrangement is that the cooling liquid in a very simple manner is passed practically continuously from a stationary liquid supply conduit via the water bath into the cooling tubes of the rotating satellite cooler.

Accordingly, the cooling liquid is hereby in a practical manner through the rotation of the furnace drawn into the cooling tubes from the liquid bath which is preferably contained in a channel member. The inventive device therefore functions in an entirely spray water free manner as compared to known devices. Furthermore, in the device according to the invention the amount of liquid to be supplied to the cooling tubes can in a very simple manner by regulated by means of an adjustment valve in the cooling liquid conduit. This provides for an accurate dosage rate of the cooling liquid quantity required at any particular time.

In an advantageous embodiment of the invention the liquid supply tubes are provided with a pocket shaped scoop member which is open in the direction of rotation and dips into the liquid bath. By means of this scoop member greater quantities of liquid can advantageously be drawn from the channel member at any specific time and introduced into the respective cooling tube.

In order to facilitate the transfer of liquid from the channel member into the liquid supply conduits and from there into the cooling tubes said liquid supply conduits extend in an advantageous embodiment of the invention at an inclination to the direction of rotation of the furnace and open into the pocket shaped scoop members.

Figure 1:
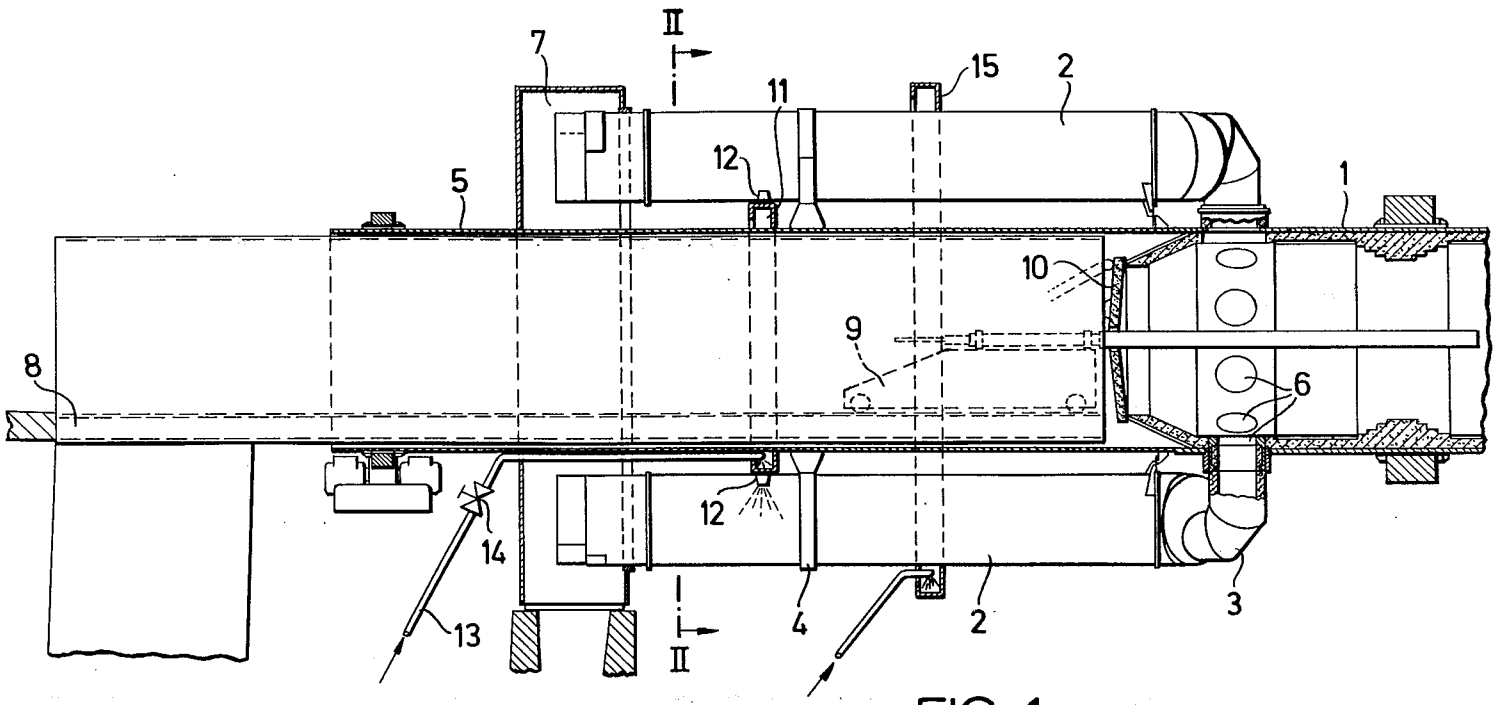
Figure 2:
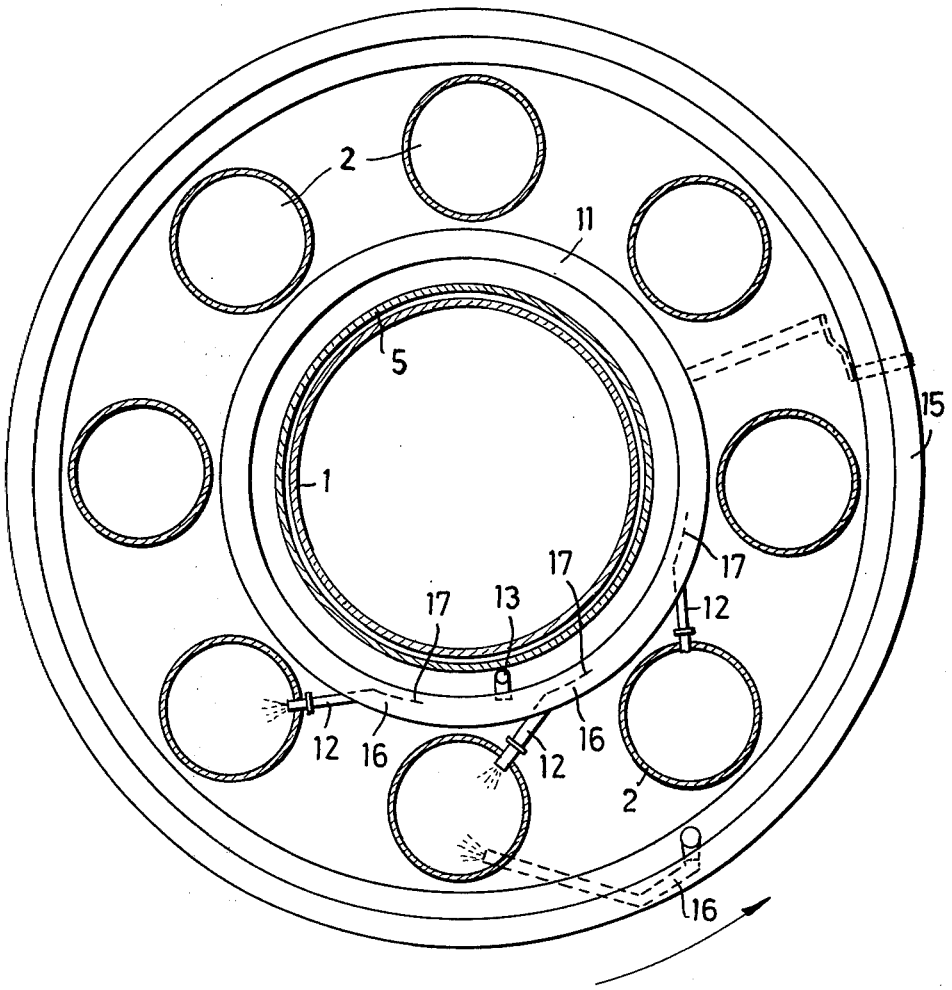
Figure 3:
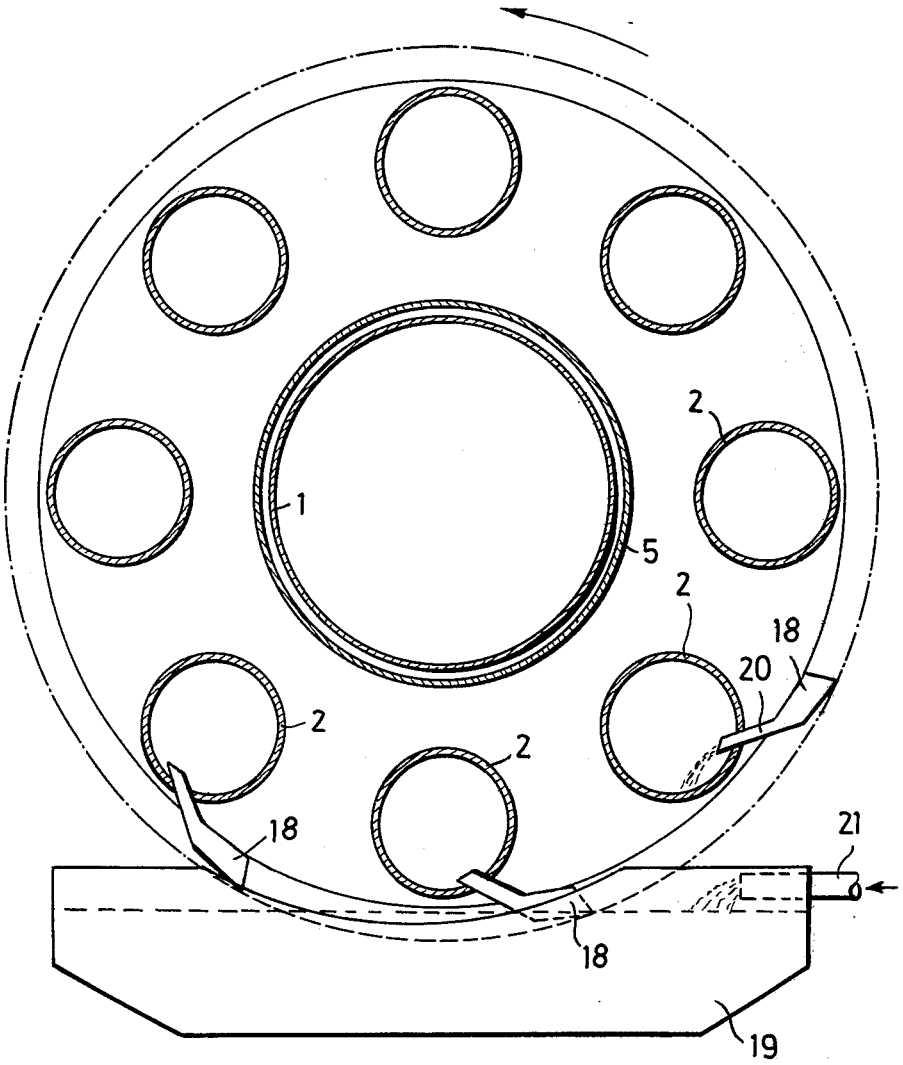
Figure 4:
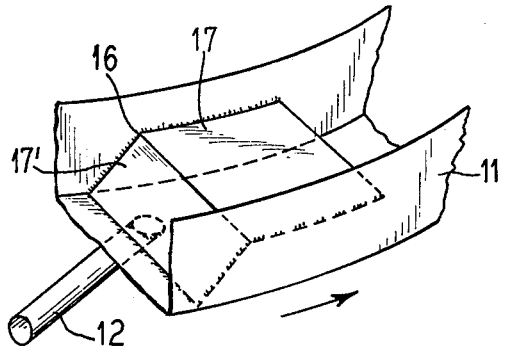

Further details, features and advantages of the invention will be apparent from the following description of preferred embodiments with reference to the accompanying diagrammatic drawings, in which FIG. 1 shows a partial longitudinal section of a satellite cooler connected with a rotary tubular furnace and provided with annular channel members mounted on the satellite cooler and on the cooling tubes, FIG. 2 shows a cross-section on line II—II in FIG. 1, FIG. 3 shows a cross-section another preferred arrangement and construction of pocket shaped scoop members according to the invention disposed outwardly of the cooling tubes; and FIG. 4 is an enlarged fragmentary view of a portion of the mechanism.

In FIG. 1 the outlet end of a rotary tubular furnace 1 is shown with a plurality of cooling tubes 2 uniformly spaced around the furnace at said outlet end. The cooling tubes 2 are, on one hand, through tubular slip connections 3 and, on the other hand, by means of holder members 4 fixedly connected with the furnace tube and with a tubular extension 5 of said furnace tube, respectively. Each slip connection 3 leading to a cooling tube 2 is through a material discharge opening 6 in communication with the furnace chamber. The end of each cooling tube opposite to the slip connection opens into a discharge housing 7 which catches the amounts of material emerging from the cooling tubes 2 and diverts said material to a conveyor means (not shown) which is disposed beneath the discharge housing. In the tubular extension 5 of the furnace 1 there is further provided a stationary platform 8 on which a burner device 9 is movable. The combustion chamber of the furnace is sealingly separated from the tubular extension 5 by means of a door 10.

The tubes 2 extend horizontally and are fixedly supported in a cluster spaced uniformly circumferentially for rotation about a horizontal axis, and means shown schematically as provided for bearing support of the tubes in the rotary movement and for driving the cluster of tubes in rotation. On the shell of the tubular extension 5 is an annular chamber 11 provided coaxially with the satellite cooler, and to said chamber member 11 liquid supply tubes 12 are connected, each opening into one of the cooling tubes 2. The liquid bath in the annular channel member 11 is maintained through a stationarily mounted liquid supply conduit 13 which in this embodiment extends freely along the wall of the extension 5 into the channel member 11.

In operation, the cooling liquid, such as water, is through the stationary conduit 13 continuously supplied to the channel member 11 in which a liquid bath is created from which the liquid is passed through the supply tubes 12 into the cooling tubes 2 in correspondence with the rotation of the furnace. The passing of the cooling liquid from the channel member 11 into the cooling tubes 12 hereby proceeds, counted in the direction of rotation of the cooling tubes, from the nadir to about the zenith of the rotary path described by the cooling tubes 2. The amount of water to be supplied to the cooling tubes is advantageously adjustable by means of a control valve 14 provided in the conduit 13. This provides for a very accurate dosage rate of the cooling water amount required in the cooling tubes at any specific time.

It may also be expedient to place a channel member 15 exteriorly around the satellite cooler or to provide an additional channel member, such as 11 or 15, respectively, interiorly or exteriorly of the cooling tubes 2, the cooling liquid being supplied to the cooling tubes through suitable supply means in the same manner as described above. In such a case the second channel member, e.g., channel member 15, may suitably be spaced from the channel member 11 a greater or smaller distance longitudinally of the cooling tubes. Through this arrangement of the annular channel members 11 and 15 the cooling tubes may advantageously be continuously supplied with cooling liquid in regions separate from each other. The dosage rate of the cooling liquid may also be adjusted by means of suitable control valves (not shown) in the supply conduits.

As shown in FIG. 2, the liquid supply tubes 12 are, counted from the channel member 11, each provided with a pocket shaped scoop member 16 which is open in the direction of rotation. Preferably, said liquid supply tubes open into the pocket shaped scoop members at an inclination in relation to the rotary direction of the furnace. The walls of the scoop members extend in said direction of rotation, the bottom and side walls in this embodiment being formed by the lateral channel member walls, the channel member bottom and by fixed plate elements 17 arranged in the channel member approximately at half the height of the channel member. Through this construction and arrangement of the pocket shaped scoop members in the channel members 11 or 15 greater amounts of cooling liquid can at any time be scooped up from the channel members and passed into the cooling tubes. The supplying of liquid to the cooling tubes 2 is further efficiently supported through the arrangement of the liquid supply conduits 12 at an inclination to the direction of rotation of the furnace.

The introduction of cooling liquid into the cooling tubes of the satellite cooler can in a different embodiment, shown in FIG. 3, also very advantageously be achieved by means of separate funnel or pocket shaped scoop members 18 which are secured exteriorly to the cooling tubes and in operation — during rotation of the cooling tubes — scoop up cooling liquid from a trough or vat 19 and pass said liquid to the cooling tubes 2 through connection conduits 20. The amount of liquid to be scooped up by the scoop members 18 from the trough 19 can also in this case be controlled through suitable variation of the liquid level in the trough 19 or through throttling or increasing the supply to said trough. In order to achieve the highest possible filling degree of the scoop members 18 it is advisable to pass the cooling liquid into the trough 19 through an influent tube 21 directed oppositely to the direction of rotation of the scoop members 18. Through the construction and arrangement of the scoop members in relation to the cooling tubes 2 as shown in FIG. 3 there is also in a simple way achieved an almost continuous supply of cooling liquid to the cooling tubes 2 of the satellite cooler.

FIG. 4 illustrates in greater detail one proposed structural arrangement for picking up cooling water with rotation of the tubes. The annular channel member 11 contains the pocket-shaped scoop member 16 which is formed by plates 17 and 17', welded or otherwise attached at their edges to the sides and bottom of the channel member 11. The back plate portion 17' extends to the outer rim of the channel member so that the front of the scoop 16 is open to receive the water. Rotation is in the direction shown by the arrowed line. Water caught by the scoop 16 flows through the liquid tube 12 into the cooling pipe 2 of the satellite cooler, as generally illustrated in FIG. 2.

Obviously, the details of the embodiments shown and described may be varied or modified in several ways within the scope of the appended claims.

We claim as our invention:

1. A rotary tubular furnace with a satellite cooler, comprising:

a plurality of cooling tubes spaced about the circumference of the furnace at the outlet end thereof;

a liquid coolant bath contained in a channel member;

means for supplying liquid to said liquid bath;

at least one tubular influent means connected to each of said cooling tubes, with each of said tubular influent means being provided with a pocket shaped scoop member open in a rotary direction and adapted to intermittently dip into the liquid bath during operation of the furnace; and means for rotating said tubes about a common horizontal axis so that said scoop members are moved past said bath.

2. A rotary tubular furnace according to claim 1, in which said channel member is annular and fixedly connected to the satellite cooler.

3. A rotary tubular furnace according to claim 1, in which said tubular influent means extend at an angle to the rotary direction of the furnace and open into said pocket shaped scoop members.

4. A rotary tubular furnace according to claim 1, in which each of said scoop members is stationarily disposed in said annular channel member.

5. A rotary tubular furnace according to claim 1, in which the scoop members are funnel or pocket shaped.

6. A rotary tubular furnace with a satellite cooler constructed in accordance with claim 1 wherein said means for supplying liquid discharges liquid into said bath in a direction opposing the direction of movement of said scoop members.

7. A rotary tubular furnace with a satellite cooler constructed in accordance with claim 1:

wherein said liquid bath is in the form of an annular chamber and said influent means is in the form of plates secured to the channel forming a pocket opening at the leading end to receive coolant.

* * * * *